US006237792B1

(12) United States Patent
Skolnicki et al.

(10) Patent No.: US 6,237,792 B1
(45) Date of Patent: May 29, 2001

(54) REINFORCED BOTTLE HAVING INTEGRAL HANDLES

(75) Inventors: Debra Skolnicki, Vermillion; Jesse Carlson, Bay Village; Craig Saunders, Rocky River, all of OH (US)

(73) Assignee: State Industrial Products, Cleveland, OH (US)

( * ) Notice: Subject to any disclaimer, the term of this patent is extended or adjusted under 35 U.S.C. 154(b) by 0 days.

(21) Appl. No.: 09/232,608

(22) Filed: Jan. 19, 1999

(51) Int. Cl.[7] ..... B65D 23/00; B65D 23/10

(52) U.S. Cl. ..... 215/382; 215/384; 215/365; 215/396; 215/398; 220/771

(58) Field of Search ..... 215/382, 396, 215/365, 398, 384; 220/369, 371

(56) References Cited

U.S. PATENT DOCUMENTS

| | | | | |
|---|---|---|---|---|
| D. 73,990 | * | 11/1927 | Young | 215/382 X |
| 353,600 | * | 11/1886 | Sloan | 215/10 |
| 3,195,752 | * | 7/1965 | Cox | 215/398 X |
| 3,298,514 | * | 1/1967 | Erickson | 215/382 X |
| 4,351,434 | * | 9/1982 | Maynard, Jr. | 222/143 |
| 4,658,975 | * | 4/1987 | Cone | 215/398 X |
| 4,804,119 | * | 2/1989 | Goodall | 215/398 X |
| 4,805,793 | * | 2/1989 | Brandt et al. | 215/398 X |
| 4,805,808 | * | 2/1989 | Larson | 215/398 X |
| 4,832,211 | * | 5/1989 | Matthews et al. | 215/365 X |
| 4,877,142 | * | 10/1989 | Doering | 215/382 |
| 4,881,650 | * | 11/1989 | Bartz | 215/398 X |
| 4,892,207 | * | 1/1990 | Cullis | 215/398 |
| 4,923,098 | * | 5/1990 | Schoonover et al. | 215/398 X |
| 4,928,860 | * | 5/1990 | Knight | 215/398 X |
| 4,957,209 | * | 9/1990 | Helin | 215/365 X |
| 5,056,674 | * | 10/1991 | Swartley | 215/382 |
| 5,199,588 | * | 4/1993 | Hayashi | 220/669 X |
| 5,226,574 | * | 7/1993 | Durinzi, Jr. | 215/398 X |
| 5,265,743 | * | 11/1993 | Frohn | 215/398 X |
| 5,299,710 | * | 4/1994 | Welsch et al. | 215/398 X |
| 5,318,787 | * | 6/1994 | Brauner et al. | 215/398 X |
| 5,485,942 | * | 1/1996 | Foster | 215/398 X |
| 5,833,115 | * | 11/1998 | Eiten | 215/398 X |
| 5,862,941 | * | 1/1999 | Jones | 215/398 X |
| 5,954,216 | * | 9/1999 | Meisner et al. | 215/398 |
| 6,068,161 | * | 5/2000 | Soehnlen et al. | 215/382 X |

FOREIGN PATENT DOCUMENTS

| | | | | |
|---|---|---|---|---|
| 2664574 | * | 1/1992 | (FR) | 220/669 |

* cited by examiner

*Primary Examiner*—Sue A. Weaver
(74) *Attorney, Agent, or Firm*—Lightbody & Lucas

(57) ABSTRACT

A bottle is disclosed having a handle integral with a back wall and spaced from the plane of the bottom of the bottle, such separation being sufficient to allow a user's fingers to grip the bottle while the bottle is against a flat surface.

36 Claims, 11 Drawing Sheets

REINFORCED BOTTLE HAVING INTEGRAL HANDLES

FIELD TO WHICH THE INVENTION RELATES

This invention relates to a reinforced bottle having integral handles.

BACKGROUND OF THE INVENTION

Utility bottles have been utilized in order to transport aqueous and other substances. Examples include automotive (for antifreeze, windshield washer fluid, etc.), industrial (for cleaning solutions), and consumer (for laundry detergent, consumable liquids, etc.). The purpose of these bottles is to contain and transport the aqueous or other substances contained therein from the point of acquisition (typically a wholesale or retail store) through the point of storage to the location wherein the materials in the bottle will be utilized. A typical bottle might be a one gallon container having a narrow neck portion extending upwards off of the center of the top of the main body of the bottle, typically with a handle formed in the bottle adjacent to the narrow neck. This example bottle is utilitarian, transferring and dispensing the materials as needed. However, the handles are awkward to utilize (especially during transport) while the generally oblong lateral cross section of the bottle is inefficient for storage. In addition, there are constraints on the actual shape of the bottle due to the need to effectively transfer the forces of the material in the bottle to the external skin of such bottle. In addition to the above, the location of the neck of the bottle compromises the handling for such bottle, particularly during dispensing operations.

SUMMARY OF THE INVENTION

It is an object of this invention to increase the usability of bottles;

It is a further object of this invention to increase the storage efficiency for bottles;

It is another object of this invention to allow for multiple position storage and dispensing orientations for bottles;

It is yet another object of this invention to increase the strength of bottles;

It is still a further object of this invention to facilitate the handling of bottles;

Other objects and a more complete understanding of the invention may be had by referring to the drawings in which:

DETAILED DESCRIPTION OF THE INVENTION

Figure 1:
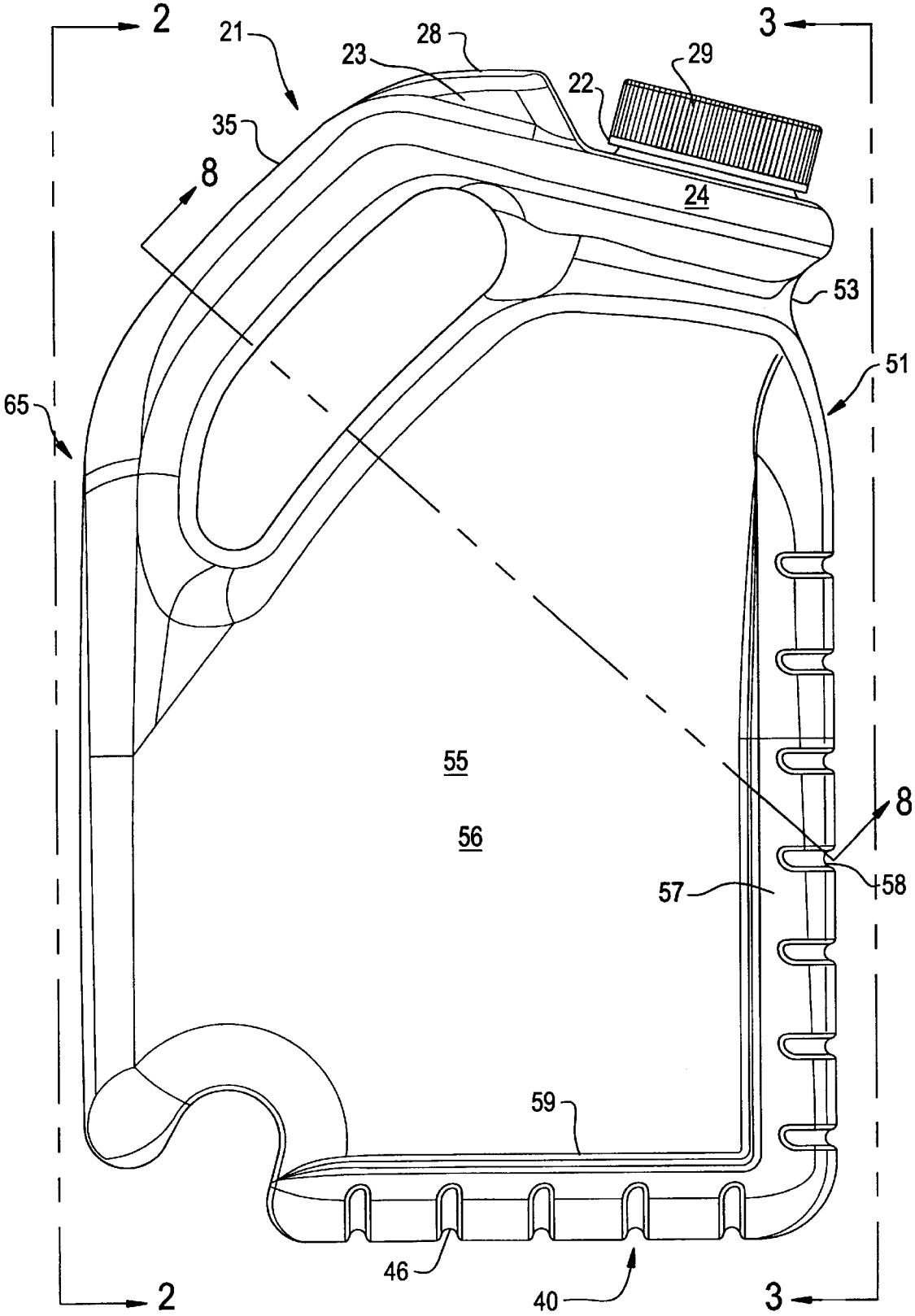
FIG. 1 is a side view of a bottle built in accord with the invention.
Figure 2:
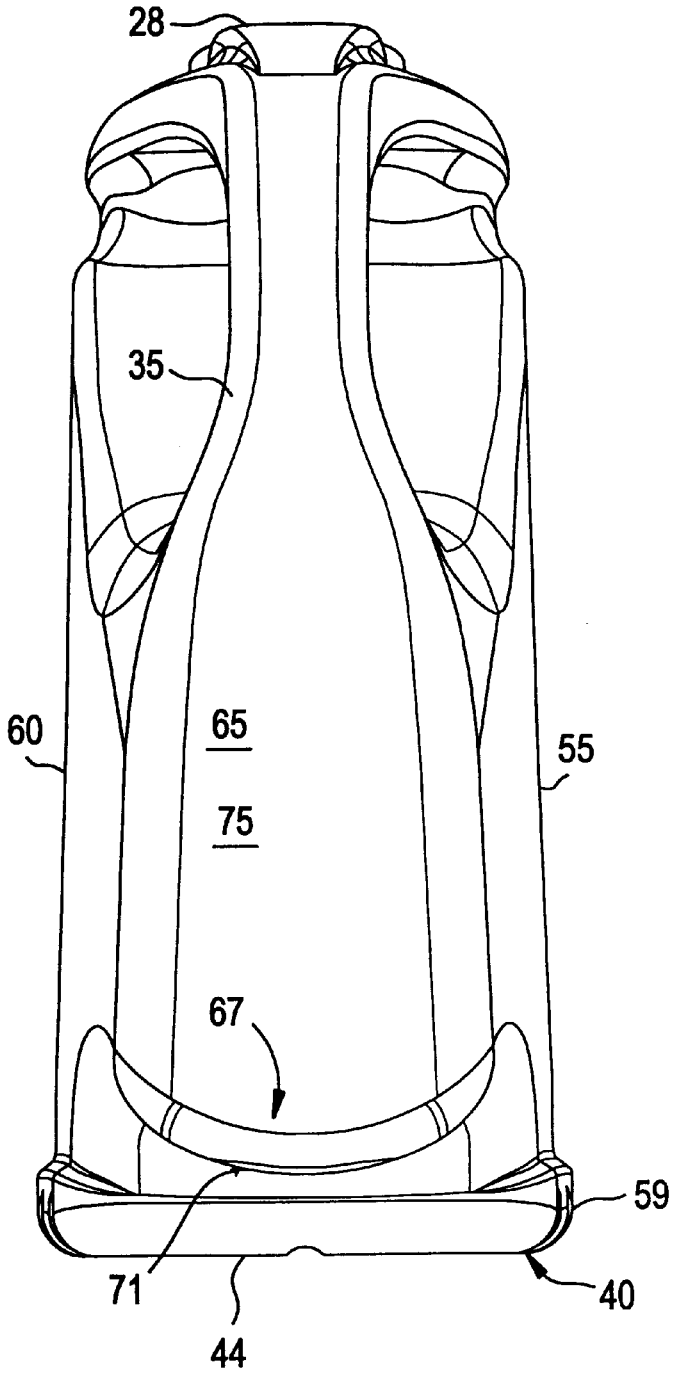
FIG. 2 is a back handle side view of the bottle of FIG. 1 taken generally along lines 2—2 therein.
Figure 3:
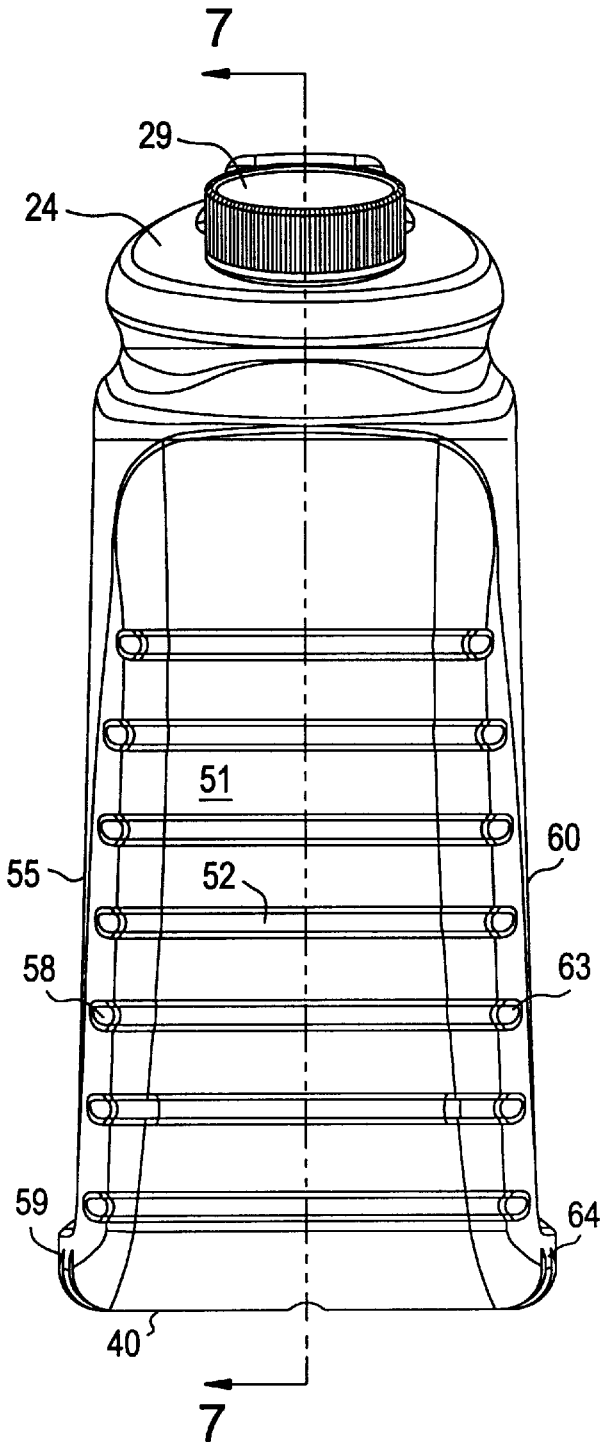
FIG. 3 is a view of the front flat support side of the bottle of FIG. 1 taken generally along lines 3—3 therein.
Figure 4:
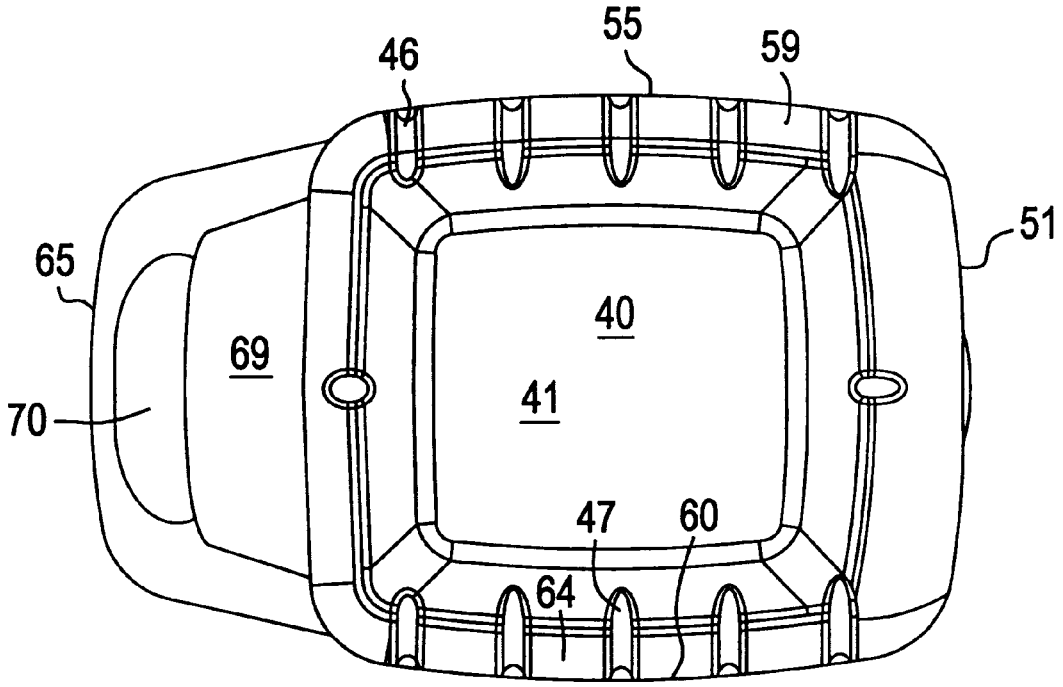
FIG. 4 is a view of the bottom of the bottle of FIG. 1.
Figure 5:
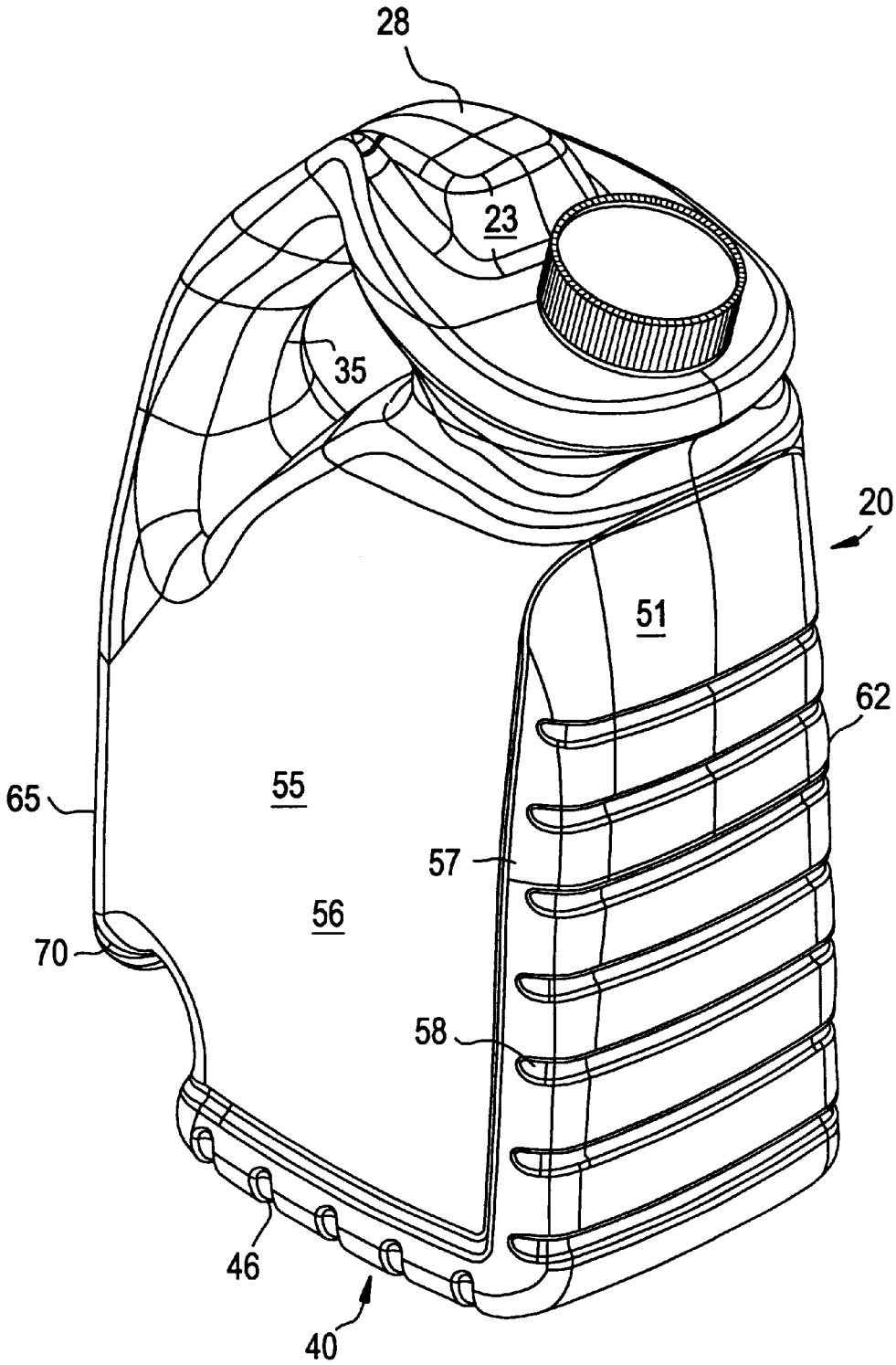
FIG. 5 is a perspective view of a bottle of FIG. 1.
Figure 6:
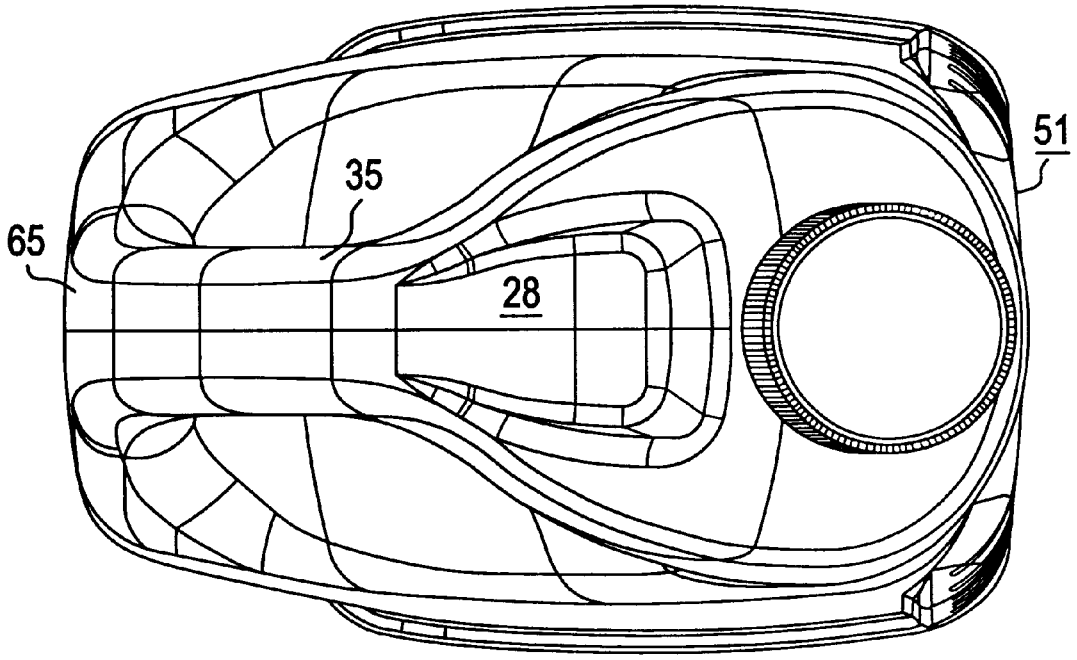
FIG. 6 is a top view of the bottle of FIG. 1.
Figure 7:
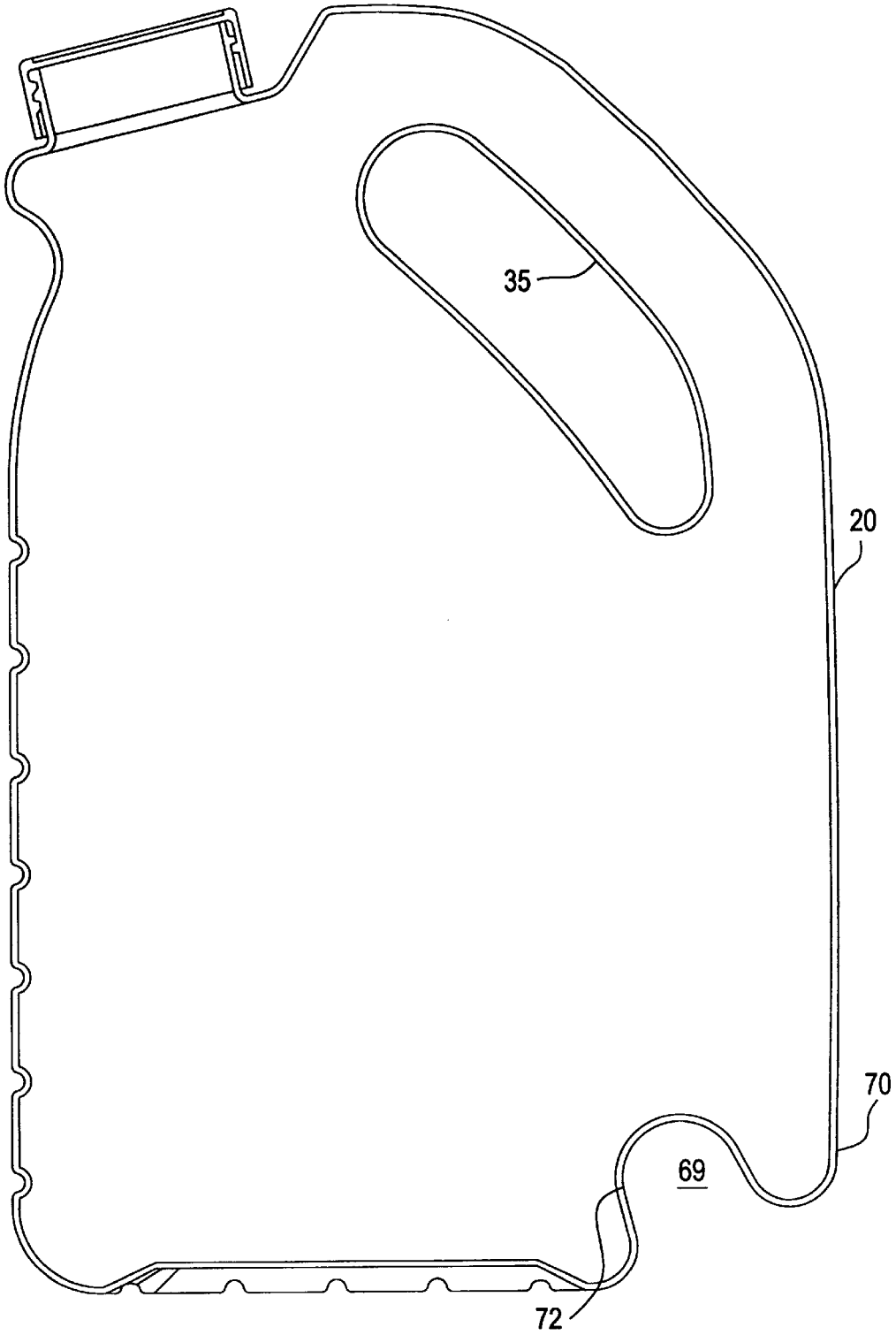
FIG. 7 is a longitudinal cross section view of the bottle of FIG. 1 taken generally along lines 7—7 in FIG. 3.
Figure 8:
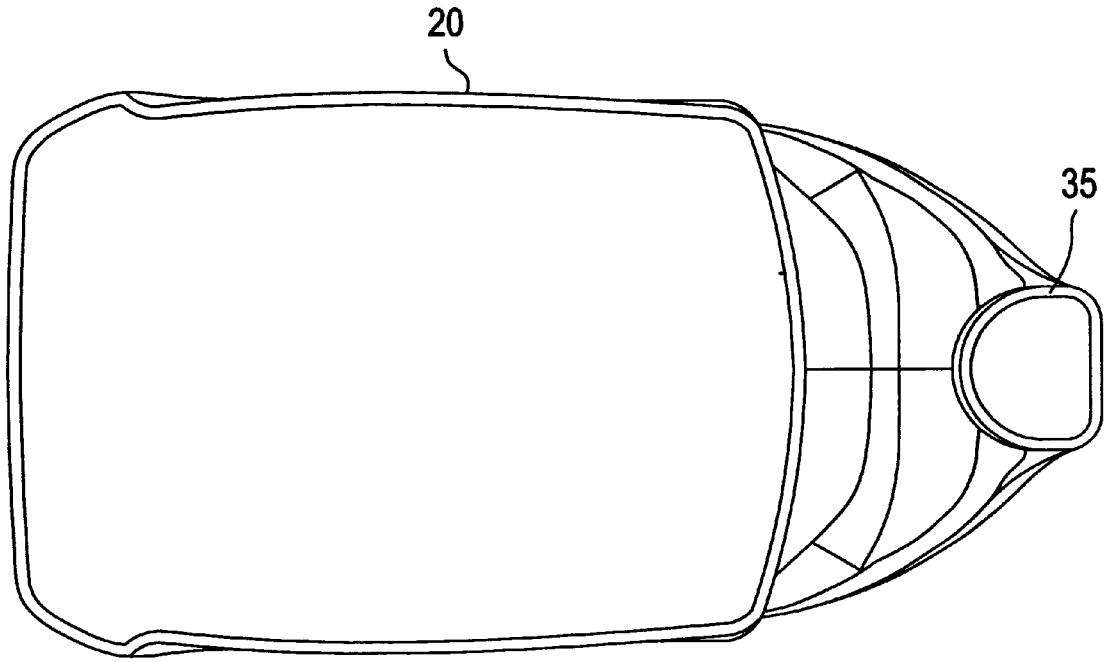
FIG. 8 is a cross sectional view of the bottle of FIG. 1 taken generally along lines 8—8 therein.

This invention relates to a bottle for containing, transporting, and dispensing aqueous or other substances.

The bottle 20 has a top 21, a bottom 40, a front planar surface 51, two sides 55, 60, and a back 65.

The top 21 of the bottle 20 serves to locate the dispensing spout 22, an auxiliary support surface 28, and a handle 35.

The spout 22 of the bottle 20 is for the filling and dispensing of the material contained within the bottle 20. The particular spout shown is a circular spout located on a generally tear drop shaped support member 24. The support member 24 in combination with the later described front planar surface 51 defines an enlarged retention notch 53. This retention notch 53 is utilized in order to steady the bottle against an adjoining surface, most typically the lip of a mixing bucket or utilizing bucket into which the materials in the bottle 20 are being dispensed.

Figure 11:
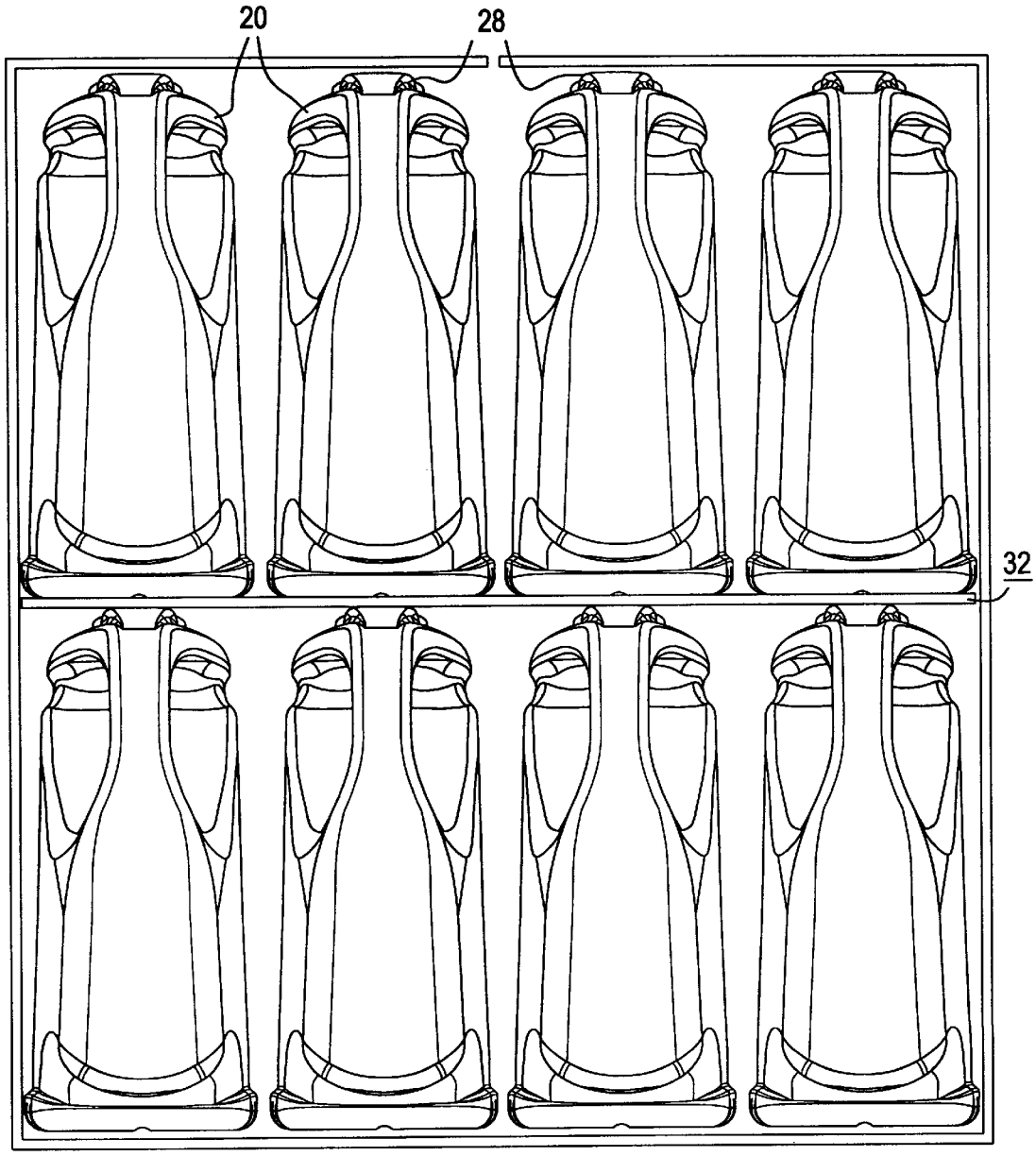

Extending off of the tear drop shaped support member 24 is an auxiliary support member 28. The auxiliary support member 28 serves to protect the top 21 of the bottle 20 including the spout 22 in addition to providing for a generally flat support surface so as to allow anything which is located on top of the bottle 20 to have an efficient and repeatable support. See for example in FIG. 11 wherein the auxiliary support 28 allows for a second row of bottles to be located above a first row with a solid support thereto. The fact that the auxiliary support member 28 is located substantially on center of the top 21 of the bottle 20 in combination with the use an optional cardboard intermediate piece 32 further facilitates this support function. The number of rows and depth of the rows (one bottle, two bottles, etc.) can vary as desired.

The auxiliary support member 28 also provides a surface for the installation of labels or other identifying indicia 29 of the contents of the bottle 20. This is particularly useful if only the top of the bottle was visible such as if the bottle was on a shelf (FIG. 10), the bottle was on end (FIG. 11), or below the user.

It is preferred that the top of the spout 22, when engaged by the associated cap 29, is located substantially lower than the auxiliary support member 28. This concentrates the forces between the bottle and any object above on the center line of the bottle without compromise to the physical integrity of the spout 22 and cap 29.

Located immediately adjoining the top 21 of the bottle 20 is a handle 35. This handle 35 serves to efficiently transfer forces from the auxiliary support member 28 to the later described back 65 of the bottle 20 in addition to providing for a convenient means for moving the bottle from place to place and dispensing materials contained within.

Most of the particular handle 35 shown extends at an angle approximately 45° in respect to the plane of the top 21 of the bottle 20. This angle allows for the handle 35 to be utilized for both transport of the bottle 20 as well as dispensing from the bottle 20. The lower end of the handle 35 (angled at an additional substantially 25° in respect to the 45° handle portion) facilitates the transfer between carrying and dispensing by allowing the user to slide his/her hands between these two positions without letting go of the handle 35.

The remainder of the back 65 of the bottle 20 serves to define a generally planar middle section 75 in addition to providing for a secondary handle 67.

The planar middle section 75 is located substantially perpendicular to the plane of the auxiliary support member 28, the plane of the bottom 40, and in addition is substantially parallel to the later described front planar surface 51. This orientation allows for the efficient concentration of bottles into a minimal space as well as providing for a support therefor in either a lateral or vertical direction.

The secondary handle 67 extends off of the back 65 of the bottle 20 somewhere along the length thereof. This secondary handle 67 provides for an auxiliary handle for manipulation of the bottle 20. This manipulation is particularly useful during the dispensing of the materials within the bottle 20. The handle 67 may be curved or square extending part or all the way across the back of the bottle 20.

The particular handle 67 shown is a generally over center circular cavity 69 in combination with a generally curved handle portion 70 located at the bottom of the back of the bottle.

The lower part 71 of the curved handle 70 is displaced from the plane 44 of the bottom 30 of the bottle 20. This displacement is preferably slightly more than the thickness of a user's fingers (½" to 1" preferred). This spacing allows for a user to grasp the curved handle 70 while the bottle 20 is located with its bottom 40 against a flat surface, albeit this the floor, a surface of a cart, or a dispensing member. The fact that the circular cavity 69 is slightly over center allows for the user's fingers to curl into a recessed area 72, thus to more precisely control the bottle 20 at this location.

The over center cavity 69 allows for a location for the user's fingers while utilizing the curved handle 70. This over center circular cavity 69 in addition provides for a location for a locking bar 78 which would serve to maintain the bottle 20 in a preselected position.

In respect to the locking bar 78 itself, this locking bar 78 is preferably sized to be the size of the over center circular cavity 69. This allows the locking bar 78 to firmly fasten into the locking cavity, while the fact that the locking cavity extends over 180° around such locking bar 78 retains the locking bar 78 into the circular cavity 69. The degree of this fit can be adjusted by altering the size of the locking bar 78, the size and wrap around of the circular cavity 69, as well as other associated parts.

Figure 10:
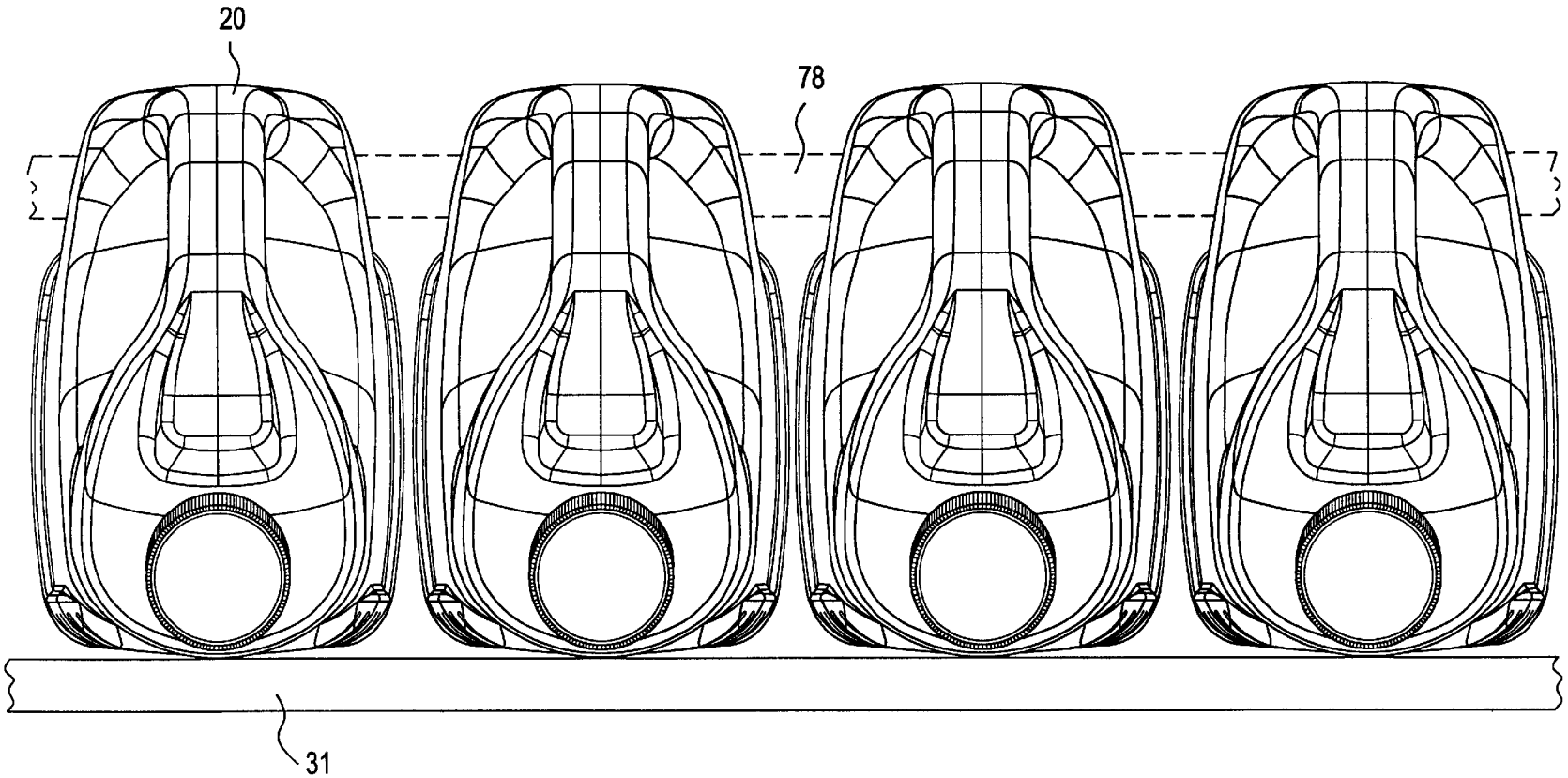
FIG. 10 is an end view of a series of four bottles in storage position on a shelf; and, FIG. 11 is a representational view of eight bottles in a packing carton.

In the example of FIG. 10, four bottles 20 are located on a shelf 31 with a locking bar 78 fastened to the back side support member for the shelf 31. With the cavity 69 having a substantially 200° wrap around on the locking bar 78, a user can forcibly move the circular cavity 69 to surround the locking bar 78 just prior to or contemporaneous with putting such bottle on the shelf 31. This locking bar 78 would thereafter serve to retain the bottles onto the shelf 31.

Figure 9:
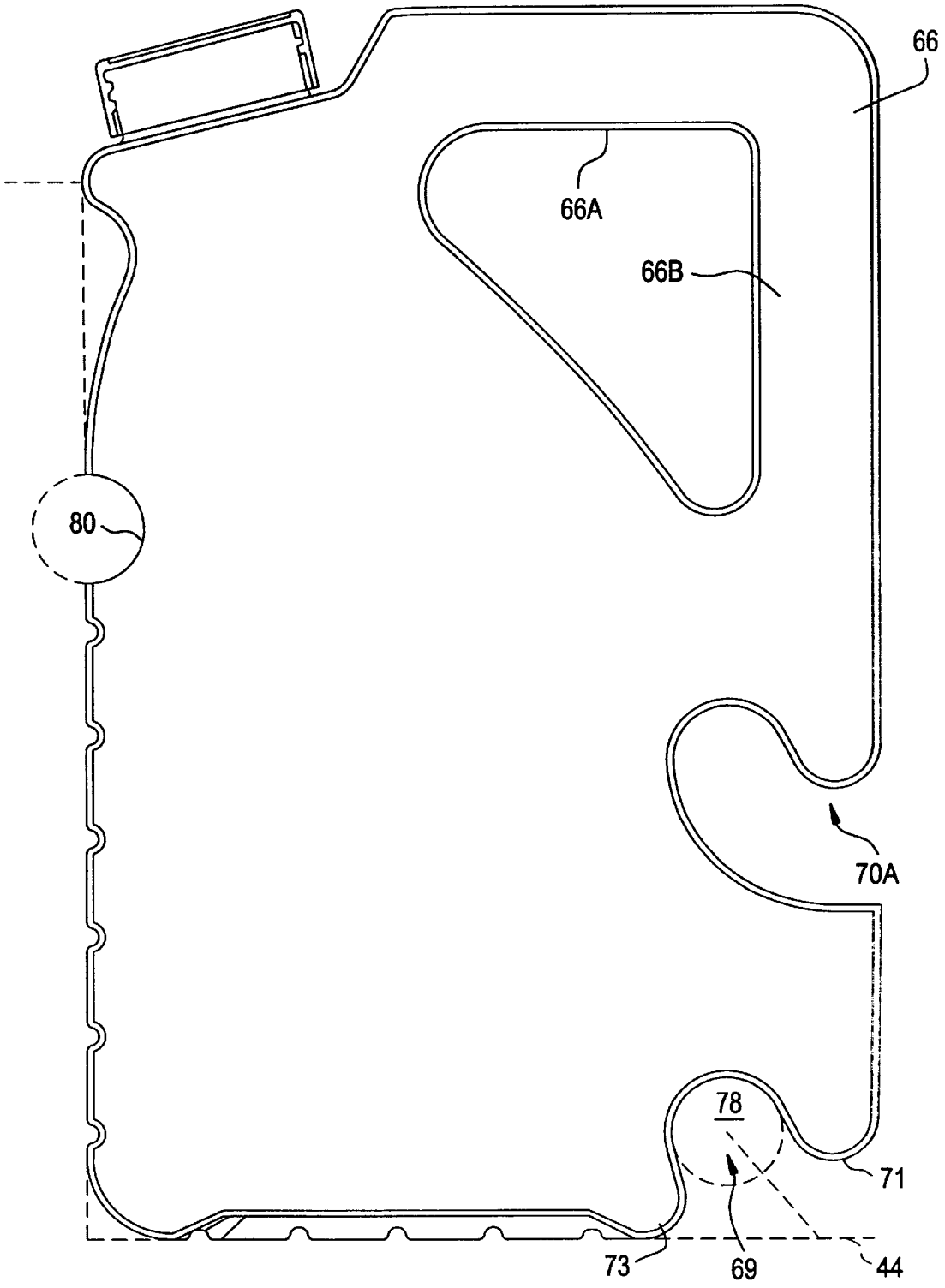
FIG. 9 is a cross sectional view like FIG. 7 of an alternate bottle shape.

The nature and quality of the cooperation between the locking bar 78 and the circular cavity 69 would depend on the sizing of the various parts as previously described as well as the orientation of the circular cavity 69. For example, as seen in FIG. 9, there is a lip 73 located adjacent to the locking bar 78. This lip would prevent the bottle 20 of this figure from being pulled directly outward; the lip would interfere with the locking bar 78. It would thus be necessary to lift the front end of the bottle slightly from the shelf 31. in order to allow the bottle to be freed.

In respect to the further cooperation with other parts, a secondary cavity 80, either by itself or in combination with the circular cavity 69, would allow for the solid retention of the bottle 20 on the shelf 31 by itself or in cooperation with the previously described circular cavity 69.

The front surface 51 of the bottle serves to reinforce the bottle 20 in addition to providing for an optional support surface for the stacking of bottles in a sideward orientation or on a shelf 31 as previously described.

The particular surface 51 disclosed is a generally planar surface having a series of sideward extending notches 52, which notches 52 form negative ribs for the planar surface thus to strengthen same. The nature and extent of these ribs would be selected in view of the pertinent application for the bottle 20.

In the preferred embodiment disclosed, in recognition of the fact that this front surface 51 is substantially planar throughout its entire dimensions, the notches 52 extend laterally across such surface for the full width thereof.

Note that at the top of this surface 51, the enlarged retention notch 53 in combination with the enlarged tear drop section 24 of the bottle 20 serves to reinforce this area. This in combination with the fact that the forces would generally be left at this location allows for the relation of notches at this location.

Each of the sides 55, 60 of the bottle 20 are substantially mirror images of each other. These sides 55, 60 serve to contain the material within the bottle 20 in addition to aiding in the passing of the forces from the auxiliary support member 28 to the bottom 40 of the bottle 20. In the embodiment disclosed, each side 55, 60 includes a recessed section 56 extending substantially the full extent of such side respectively. A reinforcing edge 57, 62 extends along the junction with the sides and the front 51. These reinforced edges 57, 62 in combination with notches 58 formed therein serve to integrally tie the body of the bottle 20 to the front surface 51 of the bottle 20. Similar reinforcing edges 59, 64 and notches 46, 47 perform the same function in respect to the bottom 40 of the bottle 20. This allows for these two surfaces 51, 40 to be utilized as support surfaces for the bottle 20 while in addition strengthening these portions against the forces of the materials contained within the bottle 20.

The bottom 40 of the bottle 20 closes the bottle. The particular bottom 40 disclosed includes a recessed center section 41 surrounded by reinforcing edges 59, 64 such edges having notches 46, 47 formed therein as previously described.

The recessed center section 41 strengthens the bottom, 40 of the bottle 20 in addition to providing for an optional support surface for the auxiliary support 28 at the top 21 of the bottle 20, should such be utilized without intermediate materials such as cardboard.

The reinforcing edges 59, 64 extend surrounding the center 41. These reinforcing edges 59, 64 cooperate with the reinforcing edges 57, 62 of the bottle 20 to solidify the strength of the bottom 40 of the bottle 20 at this location. Again, the notches in the edges further strengthen this location.

The particular bottle 20 disclosed is a bottle approximately 11.63" high, 5.06" wide, and 7.5" deep. This bottle provides for one gallon capacity (filled to 8.8"), four liters (filled to 9.75"), and a 5% overfill condition (filled to 10.75"). The handle 35 is approximately 4.36" long while the curved handle 70 is some 3.9" wide spaced from the bottom planed 44 by substantially 0.75". The uppermost extension of the cut for this curved handle 70 is some 2.13" from the plane of the bottom.

At the top 21 of the bottle 20, the cap 29 is recessed some 0.11" beneath the auxiliary support member 28. At the front 51 of the bottle 20, the reinforcing edges 57, 62 extend some 0.84" up with the notches being substantially 0.10" deep therein.

At the bottom 40 of the bottle 20, the center section 41 is recessed some 0.20" with the reinforcing edges 59, 64 extending some 0.96" from the outer edges of such bottom 40 and are again substantially 0.10" deep therein.

The diameter of the circular cavity 69 is some 1.06" with the furthest extent being some 1.525" from the bottom 40 of the bottle 20.

The bottle 20 weighs some 1.65 grams and has 0.038" side walls.

Although the invention has been described in its preferred form with a certain degree of particularity, it is to be understood that numerous changes can be made without deviating from the invention as herein after claimed.

An example of this is shown in FIG. 9 wherein the main handle has been separated into two sections, 66A, 66B. One portion 66A is optimized for carrying the bottle, while the other section 66B is optimized for dispensing the contents of the bottle. An additional example, also shown in FIG. 9 is the relocation of the handle 70A upwards of the bottom 40 of the bottle 20 in addition to/or instead of the preferred location at the lower corner of the bottle. The location of this alternate handle nearer to or away from the center of gravity of the bottle as it moves from on upright to dispensing position would control the forces on this alternate handle. It is preferred that the alternate handle would be located from a position spaced from the bottom of the bottle to a position less than the center of gravity of the bottle in a dispensing position. This alternate position would facilitate dispensing and other control of the bottle by reducing the forces on the main handle 35. Other modifications are also possible.

What is claimed:

1. In a bottle having a primary handle adjoining its top, a back with a width, and a bottom defining a plane, the improvement of a secondary handle, said secondary handle being separate from the primary handle, and said secondary handle extending laterally off of the back of the bottle spaced from the plane of the bottom of the bottle all of the way across the width of the back of the bottle.

2. The bottle of claim 1 characterized in that said secondary handle has a lower part and said lower part displaced from the plane of the bottom by more than the thickness of the user's fingers.

3. The bottle of claim 2 characterized in that said secondary handle includes a circular cavity at the inner end thereof.

4. The bottle of claim 3 characterized in that said circular cavity has a diameter and said diameter being greater than the displacement of said lower part from the plane of the bottom of the bottle.

5. The bottle of claim 3 characterized in that the primary handle has a longitudinal axis, said circular cavity has an axis, and said axis of said circular cavity being substantially perpendicular to said longitudinal axis of the primary handle.

6. The bottle of claim 1 characterized in that said secondary handle has a lower part and said lower part displaced from the plane of the bottom by ½" to 1".

7. The bottle of claim 1 characterized in that said secondary handle includes a cavity, and said cavity extending over center to provide for a recessed area.

8. The bottle of claim 7 wherein such bottle needs be maintained in a preselected position and characterized by the addition of a locking bar and said locking bar being in said cavity to locate the bottle in the preselected position.

9. The bottle of claim 8 characterized in that said cavity extends over 180° around said locking bar.

10. The bottle of claim 1 characterized in that the back of the bottle has a middle planar section perpendicular to the plane of the bottom and said secondary handle extending off of said middle planar section.

11. The bottle of claim 1 characterized in that said secondary handle is generally curved cross section across the back of the bottle.

12. The bottle of claim 1 characterized in that said secondary handle extends substantially parallel to the plane of the bottom of the bottle.

13. The bottle of claim 1 wherein the top defines a plane and characterized in that the primary handle is located at an angle in respect to the plane of the top.

14. The bottle of claim 13 characterized in that said angle is substantially 45°.

15. The bottle of claim 14 characterized in that the primary handle has a lower end and said lower end angled a further substantially 25° than said angle of 45°.

16. The bottle of claim 13 characterized in that the primary handle includes a portion located with said angle being substantially 90°.

17. The bottle of claim 1 characterized in that the primary handle has a longitudinal axis and said longitudinal axis being at an angle in respect to the top of the bottle.

18. The bottle of claim 17 characterized in that said angle is approximately 45°.

19. The bottle of claim 18 characterized in that the primary handle has a lower end and said lower end being angled at approximately an additional 25° than said angle.

20. The bottle of claim 1 wherein the back has a plane and characterized by the addition of a cavity, said cavity forming an axis and said axis is displaced inward from the plane of the back at the intersection of such plane of the back to the plane of the bottom of the bottle.

21. The bottle of claim 20 characterized in that the said cavity includes a generally over center section.

22. In a bottle having a top, the improvement of an auxiliary support member, said auxiliary support member extending off of the top of the bottle, said auxiliary support member being the uppermost part of the bottle, a bottle content identifying indicia and said indicia being on said auxiliary support member.

23. In a bottle having a top, the improvement of an auxiliary support member, said auxiliary support member extending off of the top of the bottle, said auxiliary support member being the uppermost part of the bottle, the bottle having a back and a handle, and said handle adjoining the top of the bottle extending between said auxiliary support member and the back of the bottle.

24. In a bottle having a primary handle adjoining its top, a back defining a plane, and a bottom defining a plane, the improvement of a secondary handle, said secondary handle being separate from the primary handle, and said secondary handle extending laterally off of the back of the bottle spaced from the plane of the bottom of the bottle across the width of the back of the bottle, said secondary handle having an axis, and said axis being displaced inward of the intersection of the plane of the back and the plane of the bottom of the bottle.

25. The bottle of claim 24 characterized in that said secondary handle includes a cavity, and said cavity extending over center to provide for a recessed area.

26. The bottle of claim 24 characterized in that the back of the bottle has a middle planar section perpendicular to the plane of the bottom and said secondary handle extending off of said middle planar section.

27. The bottle of claim 24 characterized in that said secondary handle is generally curved cross section across the width of the back of the bottle.

28. The bottle of claim 24 characterized in that said secondary handle extends substantially parallel to the plane of the bottom of the bottle.

29. The bottle of claim 24 characterized in that said secondary handle includes a circular cavity at the inner end thereof.

30. The bottle of claim 29 characterized in that said circular cavity has a diameter and said diameter being greater than the displacement of said lower part from the plane of the bottom of the bottle.

31. The bottle of claim 29 characterized in that the said cavity includes a generally over center section.

32. In a bottle having a primary handle adjoining its top, a back defining a plane, and a bottom defining a plane, the improvement of a secondary handle, said secondary handle being separate from the primary handle, said secondary handle extending laterally off of the back of the bottle spaced from the plane of the bottom of the bottle all of the way across the width of the back of the bottle, said secondary handle having an axis, said axis being displaced inward of the intersection of the plane of the back and the plane of the bottom of the bottle, said secondary handle including an inner cavity and said cavity extending over center to provide for a recessed area.

33. The bottle of claim 32 characterized in that said secondary handle has a lower part and said lower part displaced from the plane of the bottom by more than the thickness of the user's fingers.

34. The bottle of claim 32 characterized in that said secondary handle has a lower part and said lower part displaced from the plane of the bottom by ½" to 1".

35. The bottle of claim 32 characterized in that said secondary handle is generally curved cross section across the width of the back of the bottle.

36. The bottle of claim 32 wherein the bottle has two opposing sides and characterized in that said secondary handle extends through the sides of the bottle.

* * * * *